US007778584B2

(12) United States Patent
Nishiyama et al.

(10) Patent No.: US 7,778,584 B2
(45) Date of Patent: Aug. 17, 2010

(54) THERMAL FIXING DEVICE AND IMAGE FORMING DEVICE

(75) Inventors: Ryuji Nishiyama, Ibaraki (JP); Shitaro Kawai, Ibaraki (JP)

(73) Assignee: Canon Finetech Inc., Misato-shi, Saitama (JP)

( * ) Notice: Subject to any disclaimer, the term of this patent is extended or adjusted under 35 U.S.C. 154(b) by 11 days.

(21) Appl. No.: 12/135,969

(22) Filed: Jun. 9, 2008

(65) Prior Publication Data

US 2008/0292376 A1 Nov. 27, 2008

Related U.S. Application Data

(62) Division of application No. 11/281,914, filed on Nov. 16, 2005, now Pat. No. 7,424,260.

(30) Foreign Application Priority Data

Nov. 25, 2004 (JP) ..... 2004-341227

(51) Int. Cl.
*G03G 15/20* (2006.01)

(52) U.S. Cl. ..... 399/329; 399/334

(58) Field of Classification Search ..... 399/329, 399/330, 334
See application file for complete search history.

(56) References Cited

U.S. PATENT DOCUMENTS 6,618,574 B2 * 9/2003 Nishitani ..... 399/329
2005/0008413 A1 1/2005 Takagi et al.

FOREIGN PATENT DOCUMENTS

| | | |
|---|---|---|
| JP | 62027781 | 2/1987 |
| JP | 01213683 | 8/1989 |
| JP | 04204980 A | 7/1992 |
| JP | 2000-029339 | 1/2000 |

* cited by examiner

*Primary Examiner*—David M Gray
*Assistant Examiner*—Erika Villaluna

(57) ABSTRACT

The contact rate between a heater 1 and a heater holder 2 is made higher at both ends in the longitudinal direction of the heater than at the center. Alternatively, the per-unit-length volume of the heater holder 2 in the longitudinal direction is made larger at the both ends in the longitudinal direction of the heater. In this configuration, the heat generated by the heater can easily escape into the heater holder side at the both ends but cannot easily escape into the heater holder side at the center. Although the per-unit-length heat amount in the longitudinal direction of the heater 1 may be even, it is also possible to set the heat amount distribution in such a way that the heat amount at the both ends is larger than that at the center. The present invention prevents an improper fixing problem generated by an insufficient temperature at a particular position of a recording material and, at the same time, prevents an increase in the temperature of the non-paper-passage part that occurs when a narrow recording material is used.

7 Claims, 18 Drawing Sheets

SECTION VIEW AT
CENTER IN LONGITUDINAL DIRECTION

SECTION VIEW AT
END IN LONGITUDINAL DIRECTION

SECTION VIEW AT
CENTER IN LONGITUDINAL DIRECTION

SECTION VIEW AT
END IN LONGITUDINAL DIRECTION

SECTION VIEW AT
CENTER IN LONGITUDINAL DIRECTION

TEMPERATURE DISTRIBUTION
OF HEATER

SECTION VIEW AT
END IN LONGITUDINAL DIRECTION

SECTION VIEW AT
CENTER IN LONGITUDINAL DIRECTION

THERMAL FIXING DEVICE AND IMAGE FORMING DEVICE

DETAILED DESCRIPTION

1. Field of the Invention

The present invention relates to a heater for heating an object to be heated, and more particularly to a heat fixing device and an image forming device for melting and fixing a toner image onto a recording material (copy material) in a xerography device.

2. Related Art

Some of image recording devices, such as a printer, a copier, a recording device, and a facsimile, use a heat fixing device. This heat fixing device is a device, used in a recording unit of xerography, for forming an unfixed image, corresponding to image information to be recorded, on a recording material and for heat fixing the unfixed image thereon. A typical heat fixing method is a heat roller method in which a recording material is heated while it is held between, and transported, by a heat roller heated at a predetermined temperature and a pressure roller with an elastic layer thereon that presses against the heat roller. However, the heat roller method has a problem that it takes a long warm-up time until the surface of the heat roller reaches a fixing temperature.

To solve this problem, another heat fixing method, which has high heat-transfer efficiency and a short startup time, is proposed to replace the heat roller method described above. More specifically, a heating device employing the film heating method, in which a fixed low heat-capacity thermal heater and a thin film that slide on the heater are used, is proposed (see Japanese Patent Laid-Open Publication No. Hei 2-157878, Japanese Patent Laid-Open Publication No. Hei 4-44075, and Japanese Patent Laid-Open Publication No. Hei 4-204980).

FIG. 6A is a cross sectional schematic diagram showing an example of the principal part of an image heating device (heat fixing device) using the film heating method. FIG. 6B is a partial cutaway top view of a heater, and FIG. 6C is a top view of the heater fitting groove of a heater holder.

A ceramic heater 1, a heater, is fitted and fixed in a heater fitting groove 2*a* provided in the longitudinal direction on the bottom surface of a heater holder 2 that is rigid and heat-stable A film 3 is a heat-stable fixing film. To reduce the heat capacity to improve the quick start capability, this film 3 is usually a composite film made of a 100 μm or thinner, heat-stable, mold-releasing, durable polyimide film on which PTFE, PFA, or FEP is coated as the mold-releasing layer.

A pressure roller 4, which works as a pressure member, is an elastic roller made of heat-stable rubber. This elastic roller presses against the bottom surface of the heater 1 to form a nip portion N (heating nip or fixing nip portion). The film 3 is nipped in the nip portion N.

This pressure roller 4 conveys the film 3 slidingly in the arrow direction with the film 3 pressed against the bottom surface of the ceramic heater 1. A recording material P, such as paper on which an image is to be fixed, is held between the film 3 and the pressure roller 4 in the nip portion N as a material to be heated and is conveyed with the film 3. This causes the heat of the ceramic heater 1 to be transferred to the recording material via the film 3 and an unfixed image (toner image) t on the recording material P to be heat-fixed onto the recording material surface. A part of the recording material that has passed through the nip portion N is kept conveyed while separating sequentially from the surface of the film 3 with a predetermined curvature.

The ceramic heater 1, which works as a heater, is a low-heat-capacity flat member comprising the following components.

a. Heater substrate 1*a* that is a rectangular, thin flat-plate with its long side orthogonal to the movement direction a of the film 3 or the recording material P (perpendicular to the plane of FIG. 6A) in the nip portion N. This heater substrate 1*a* is heat-stable, low in heat capacity, high heat-conductive, and electrically insulating.

b. Electric resistant heater 1*b* that is for example a strip provided on one face (surface) of the heater substrate 1*a* in the longitudinal direction of the substrate. This electric resistant heater 1*b* generates heat when conducted.

c. Surface protective layer 1*c* that coats one face (surface) side of the heater substrate 1*a* on which the electric resistant heater 1*b* is provided. This surface protective layer 1*c* is heat-stable and electrically insulating.

d. Temperature sensing element 1*d* provided on the other side (rear surface) of the heater substrate 1*a*

In this embodiment, the heater substrate 1*a* is, for example, a ceramic substrate made of alumina (aluminum oxide $Al_2O_3$) that is 240 mm in length, 10 mm in width, and 1 mm in thickness.

The electric resistant heater 1*b* is a strip, 10 μm in thickness and 1-3 mm in width, created by pattern-coating and burning (for example, by via screen-printing) an electrically-resistant material paste (resistant paste) of silver palladium (Ag/Pb), $Ta_2N$, and so on in the longitudinal direction of the substrate on the surface of the heater substrate. Conducting electrodes 1*e* and 1*e*, connected to the both ends of the electric resistant heater 1*b* for conduction, are formed on the surface of the heater substrate. The conducting electrodes 1*e* and 1*e* are formed by coating and burning the Ag paste by screen-printing.

The surface protective layer 1*c* is a heat-stable glass layer about 10 μm in thickness. The temperature sensing element 1*d* is a chip-type or printed thin-film type thermistor.

This heater 1 is fitted and fixed in a heater fitting groove 2*a* formed on the bottom surface of the heater holder 2 in the longitudinal direction, with the surface of the heater substrate 1*a*, on which the electric resistant heater 1*b* and surface protective layer 1*c* are formed, faced downward. In this configuration, the heater 1 fitted in the heater fitting groove 2*a* abuts directly on a heater abutment surface 2*b* in the groove 2*a*. A concave portion is created at the center of the bottom of the heater fitting groove 2*a* to provide a gap 2*c* to minimize the escape of heat from the bottom of the heater to the heater holder 2 side to improve the heating efficiency of the nip portion N.

The heater 1 is heated quickly when the electric resistant heater 1*b* is heated along its length by the power supplied from the power-supply circuit, not shown, to the electric resistant heater 1*b*. The temperature sensing element 1*d* senses a rise in the temperature. The sensed temperature information is input to a temperature control circuit, not shown, that controls the power supply to the electric resistant heater 1*b* so that the temperature of the heater 1 is maintained at a predetermined temperature (temperature adjustment). The heater 1 is supported by the crown-shaped continuous surface in the longitudinal direction of the heater holder 2 so that the pressure is applied evenly along its length.

In the prior art described above, a concave portion is created to provide the gap 2*c* in the bottom of the heater holder 2, where the heater abuts, to increase the heating efficiency of the fixing side as described above. The problem with this configuration is that the rate of heat escape from the heater 1 to the heater holder 2 differs according to positions with the result that the temperature distribution in the longitudinal direction of the heater 1 is not always even during the actual use.

FIG. 7 shows the temperature distribution in the longitudinal direction of the heater 1 when the heat amount of the heater 1 is made even with the heater 1 abutting on the heater holder 2 as shown in FIG. 2; as shown in the figure, the temperature at the ends is lower than that of the center. This is because the heat is transferred only in one direction at the ends and because the heat escapes into a part other than the electric resistant heater, for example, into the electrodes. This results in a fixing failure due to an insufficient temperature at the ends and causes the problem of the so-called toner peeling. In addition, when 50 sheets of narrow-size (A5-size) paper pass through the nip portion N, the temperature of the non-paper-passage part rises to 242° C. as shown in FIG. 8 and the difference in temperature from that of the center part is increased up to about 60° C.

An attempt to extend the gap 2*c* in the heater abutment/support part of the heater holder 2 to prevent the toner peeling described above decreases the rate of heat escape from the heater 1 to the heater holder 2. Therefore, when a narrow recording material passes through the nip portion, the temperature of the non-paper-passage part where no recording material passes rapidly increases. In addition, the heat stress generated inside the heater 1 tends to cause a crack. A still another problem is that, when a pressure is applied, the strength of the heater-mounting surface of the heater holder 2 is reduced to such an extent that the heater holder 2 cannot hold the heater.

Therefore, it is an object of the present invention to reduce a temperature difference between the center and the ends especially when small-size paper passes, to ensure the fixing of toner on small-size paper, and to prevent a temperature rise in a non-paper-passage part.

It is another object of the present invention to provide a heat fixing device and an image forming device that can prevent a fixing failure caused in a specific part of a recording material due to a insufficient temperature and, in addition, prevent a temperature rise in anon-paper-passage part caused when a narrow recording material is used.

SUMMARY OF THE INVENTION

A heat fixing device according to the present invention is a heat fixing device for heat fixing an unfixed image formed on a recording material, comprising a heater having a heating element; and a heater holder for supporting the heater, wherein a contact rate between the heater and the heater holder is set higher at ends of the heater than at a center thereof in a longitudinal direction.

More specifically, to change the contact rate, the heater contacts the heater holder at the ends of the heater in the longitudinal direction on at least one surface of the heater, with a gap between the heater and the heater holder formed at the center.

Instead of changing the contact rate, the thickness of the heater holder may be made larger at both ends in the longitudinal direction of the heater than at the center.

This configuration allows the amount of heat transferred to the heater holder to be increased or decreased locally for efficiently transferring the heat of the heater to the fixing nip side. Therefore, this configuration prevents a toner-peeling problem that would develop because of an insufficient temperature when small-size paper of narrow, relatively poor fixability (such as post cards or envelops) passes through the nip.

Another heat fixing device according to the present invention is a heat fixing device for heat fixing an unfixed image formed on a recording material, comprising a heater having a heating element; and a heater holder for supporting the heater, wherein a distribution of a per-unit-length heat amount in a longitudinal direction of the heater is set uneven and a contact rate between the heater and the heater holder is set lower in a position where the per-unit-length heat amount is small than in a position where the heat amount is large.

In this configuration, the distribution of the heat of the heater is positively made uneven. In particular, the heat amount distribution of the heating element is set so that the heat amount at both ends in the longitudinal direction of the heater becomes higher than the heat amount at the center. At the same time, the contact rate between the heater and the holder is changed according to the distribution of the heat amount. That is, the contact rate between the heater and the holder is set lower in a position where the per-unit-length heat amount is small than in a position where the heat amount is large. More specifically, on at least one surface of the heater, the heater contacts the heater holder in the position where the per-unit-length heat amount is large and a gap is formed between the heater and the holder in the position where the heat amount is small.

This configuration increases the temperature of a position where an improper fixing problem, such as a toner peeling-off, is generated because of an insufficient temperature and prevents an improper fixing problem from being generated. At the same time, even if such a position, where the heat amount is large, passes no paper when a narrow recording material successively passes through the nip, the contact rate between the heater and the holder is increased in that position for the better radiation of the heat into the holder. Thus, this configuration prevents an extreme increase in the temperature of the non-paper-passage position.

Another heat fixing device according to the present invention is a heat fixing device for heat fixing an unfixed image formed on a recording material, comprising a heater having a heating element; and a heater holder for supporting the heater, wherein a distribution of a per-unit-length heat amount in a longitudinal direction of the heater is made uneven and a per-unit-length volume of the heater holder in a longitudinal direction is made larger in a position where the per-unit-length heat amount is large than in a position where the heat amount is small.

More specifically, in the position where the per-unit-length heat amount is small, the thickness of the holder can be made smaller than that in the position where the heat amount is large. This configuration provides the same effect as that described above.

In another aspect, a heat fixing device according to the present invention is a heat fixing device for heat fixing an unfixed image formed on a recording material, comprising a heater having a heating element; and a heater holder for supporting the heater, wherein a heat amount distribution of the heating element is set so that a heat amount at both ends in a longitudinal direction of the heater becomes larger than a heat amount at a center and the heater holder is formed so that a heat generated by the heater can easily escape into a heater holder side at both ends but cannot easily escape into the heater holder side at the center.

The present invention is advantageously applicable to the film heating method described above that uses a thin film sliding on the heater.

DETAILED DESCRIPTION OF THE PREFERRED EMBODIMENTS

Preferred embodiments of the present invention will be described in detail below.

First Embodiment

Figure 9:
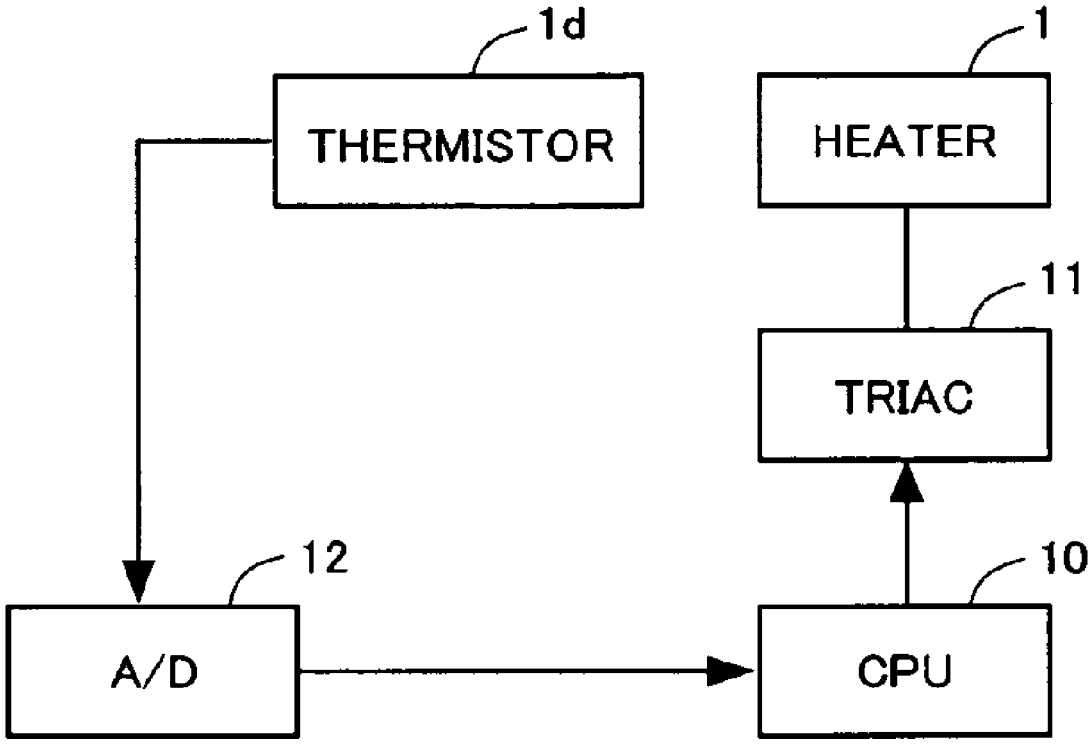
FIG. 9 is a block diagram showing the general configuration of a temperature controller (control means) of the heater.

First, FIG. 9 shows the general configuration of a temperature controller of a heater in a heat fixing device used in an image forming device in this embodiment. This configuration is the same as that of a conventional device. That is, the output of a temperature sensing element (thermistor in this embodiment) 1*d*, provided on a heater 1, is A/D converted by an A/D converter 12 and the converted result is sent to a CPU 10. Based on the received information, the CPU 10 controls the phase and the waveform of the AC voltage to be supplied to the heater 1 via a triac 11 to control the conducting power supplied to the heater. This configuration is the same as that of other embodiments that will be described below.

Figure 1A:
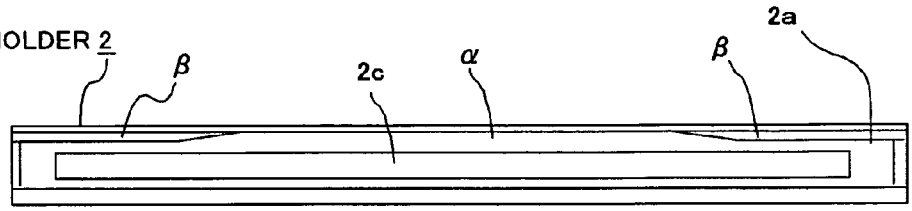
FIGS. 1A to 1C are diagrams showing the configuration of heater and heater holder in a first embodiment of a heat fixing device of the present invention.
Figure 1B:
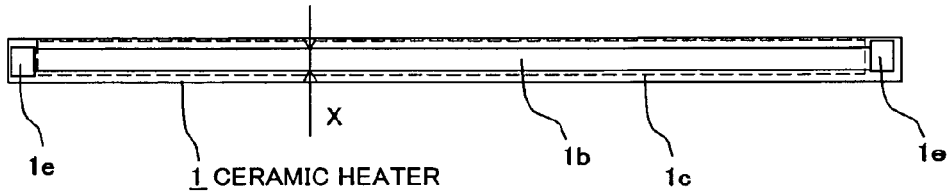
Figure 1C:
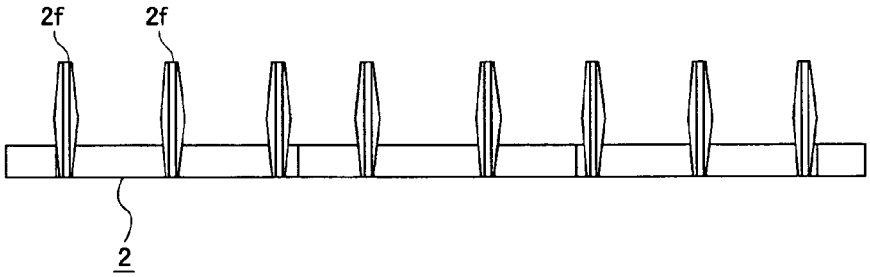
Figure 6A:
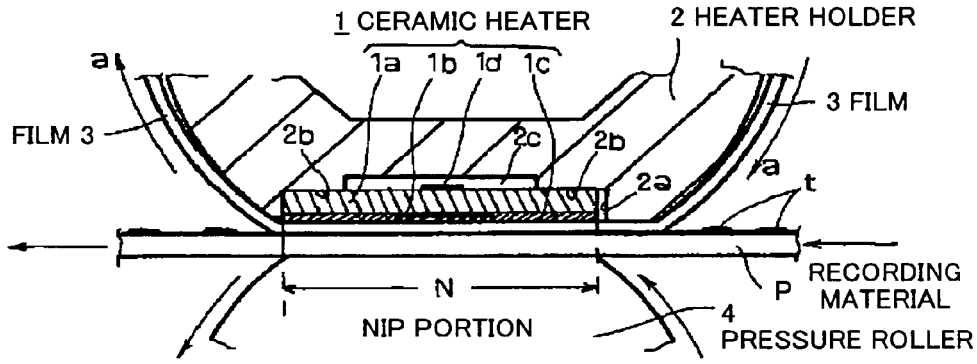
FIG. 6A is a cross sectional schematic diagram showing an example of the principal part of an image heating device (heat fixing device) using a conventional film heating method.
Figure 6B:
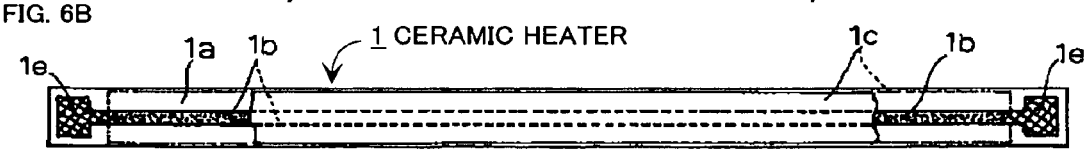
FIG. 6B is a partial cutaway top view of a heater.
Figure 6C:
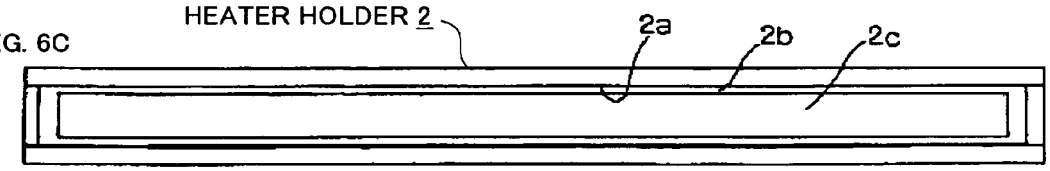
FIG. 6C is a top view of the heater fitting groove of a heater holder.
Figure 7:
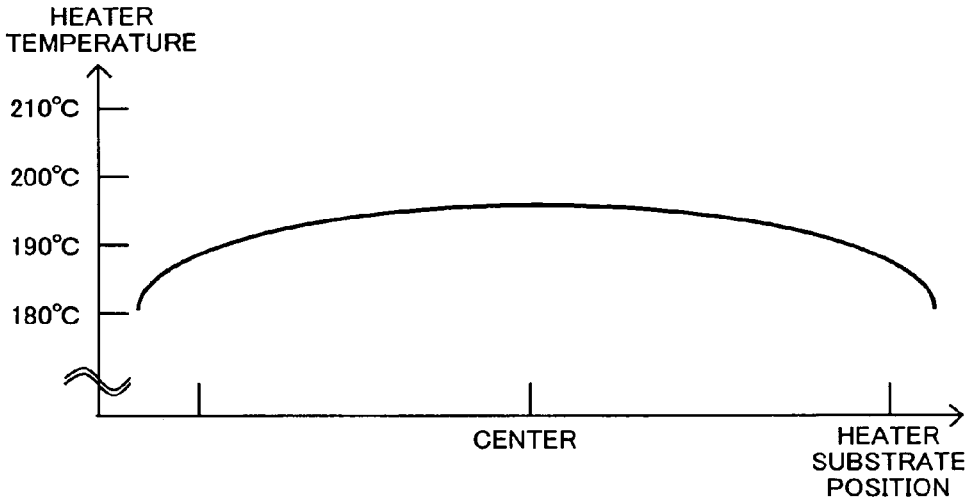
FIG. 7 is a diagram showing the temperature distribution in the longitudinal direction of a heater of a conventional heat fixing device.

FIG. 1B is a top view of the heater 1 in the first embodiment of the present invention that has a heating element that generates heat when conducted. FIG. 1A is a top view of a heater fitting groove of a heater holder 2. FIG. 1C is a front view of the heater holder 2. The structure of this heat fixing device is the same as that of a heat fixing device in the prior art shown in FIGS. 6A-6C. Although 1.0 mm thick in this embodiment, the heater substrate is not limited to this thickness.

Figure 2:
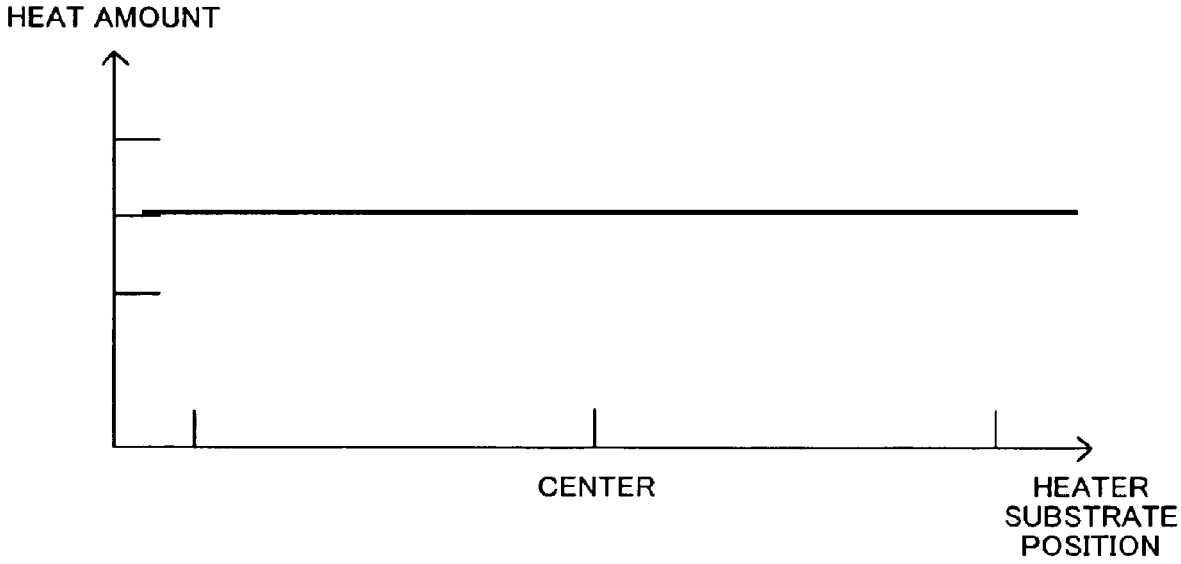
FIG. 2 is a diagram showing the heat amount distribution in the longitudinal direction of the heater of the heat fixing device in an prior art and in the first and second embodiments of the present invention.

The total length of an electric resistant heater 1*b* of the heater 1 in the figure is 220 mm and axial-direction length X is 6.5 mm. The resistance value per unit length of a position is represented by Ro. The heat amount distribution of the heater 1 is made even as shown in FIG. 2.

The heater holder 2 is made by molding heat stable resin such as PPS, liquid-crystal polymer, or phenol resin. The heater holder 2 has a heater mounting surface in which the heater 1 is fitted. The shape of the mounting surface is such that the ends in the longitudinal direction of the heater project into the heater side as shown by $\beta$, with a gap $\alpha$ between the heater holder 2 and the heater 1 at the center. As shown in FIG. 1C, ribs 2*f* are formed in multiple positions in the longitudinal direction of the heater holder to guide a conveyed film 3.

Figure 3B:
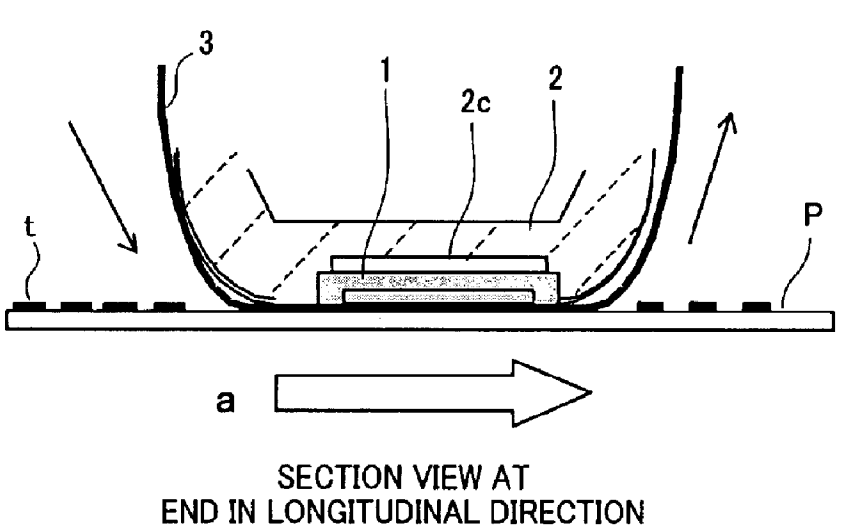
FIGS. 3A and 3B are cross sectional diagrams showing the heater abutting on the heater holder of the heat fixing device at the center and at the ends in the first embodiment of the present invention.
Figure 3A:
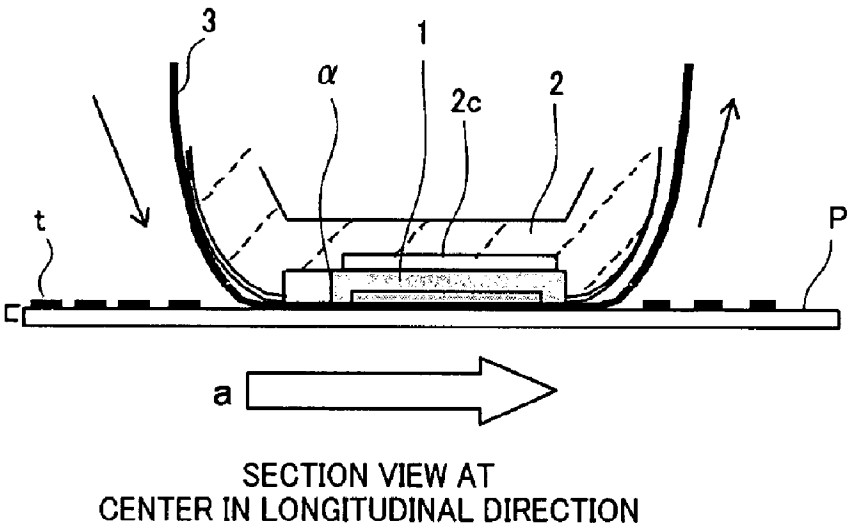
Figure 4:
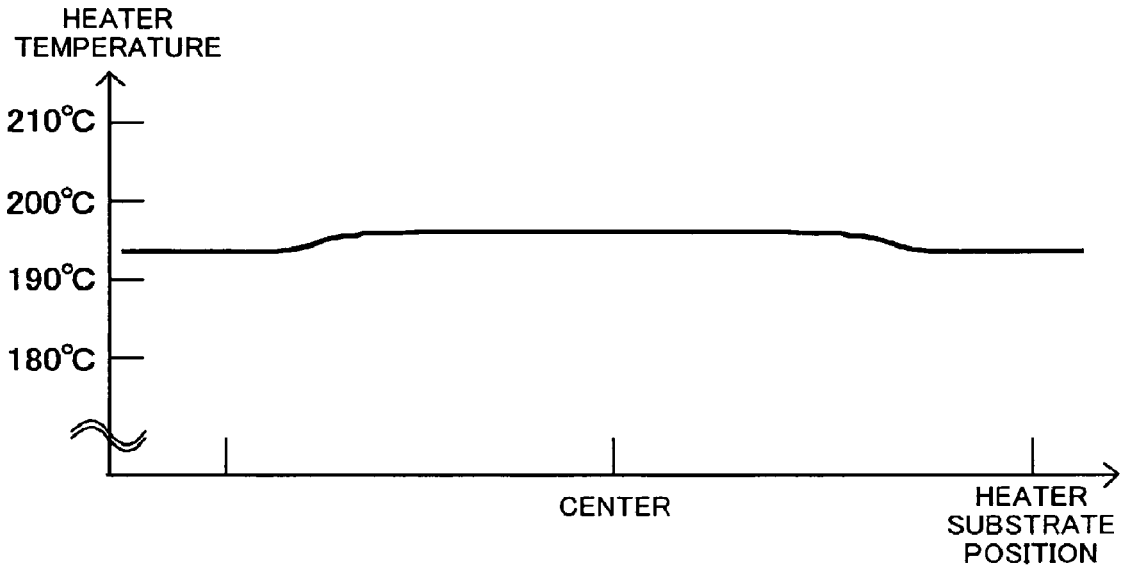
FIG. 4 is a diagram showing the heat amount distribution in the longitudinal direction of the heater of the heat fixing device in the first embodiment of the present invention.

FIG. 3A and FIG. 3B are cross sectional diagrams showing the heater 1 that abuts on, and supported by, the heater holder 2 at the center and at the end in the longitudinal direction. There is the gap $\alpha$ between the heater holder 2 and the heater 1 at the center in the longitudinal direction in FIG. 3A, while the heater holder 2 abuts on, and makes close contact with, the sides of the heater 1 at the end in the longitudinal direction in FIG. 3B. FIG. 4 shows the temperature distribution when the electric resistant heater 1*b* of the heater 1 conducts in the state described above. As shown in the figure, the temperature at the center is 195° C., and 193° C. at the ends, in the longitudinal direction. This configuration makes the contact rate per unit-volume of the heater holder 2, which supports the heater 1, higher at the ends than that at the center in the longitudinal direction of the heater substrate to decrease the radiation of heat into the heater holder 2 at the center and, conversely, to increase the radiation of heat at the ends.

Figure 5:
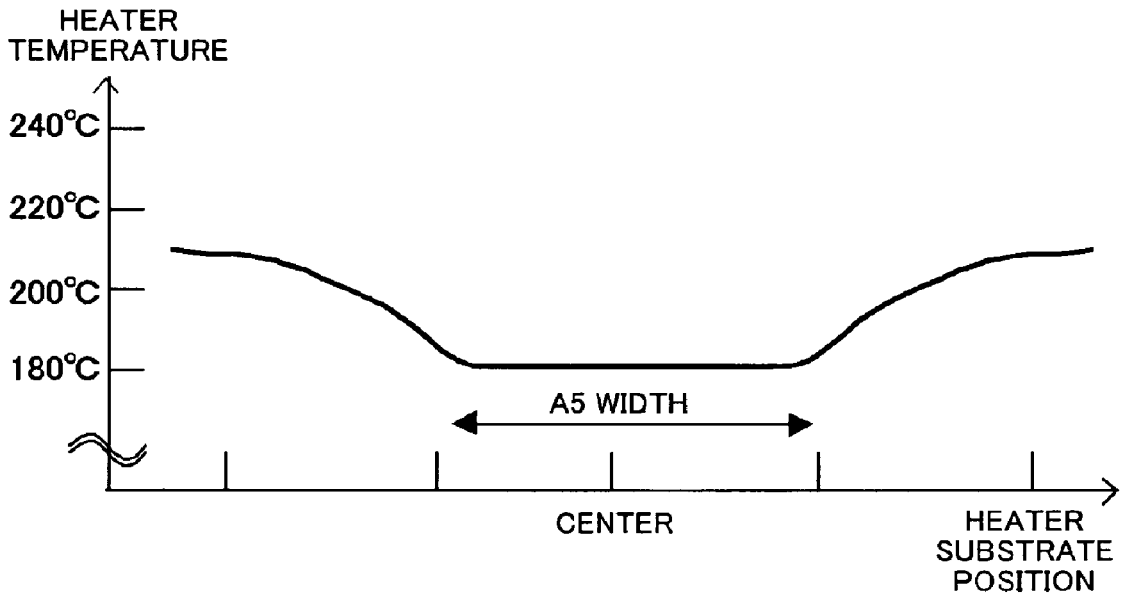
FIG. 5 is a diagram showing the temperature distribution of the heater in the longitudinal direction when small-size paper successively passes through the heat fixing device in the first embodiment of the present invention.
Figure 8:
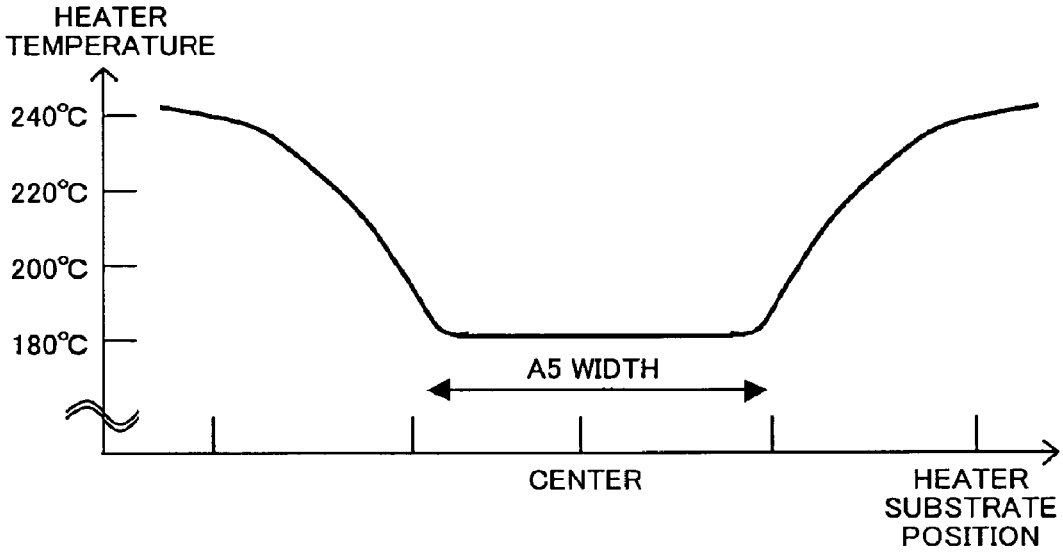
FIG. 8 is a diagram showing the temperature distribution in the longitudinal direction of the heater when small-size paper passes through the conventional heat fixing device successively.

FIG. 5 shows the temperature distribution when 50 sheets of narrow (A5 size) paper successively pass through the nip portion in this configuration. In the example shown in FIG. 5, the maximum temperature in the non-paper-passage part where no paper passes is 215° C. The comparison between this temperature with 242° C., which is the maximum temperature in the conventional configuration in FIG. 8, indicates that there is a temperature difference of about 27° C. That is, the configuration in this embodiment can keep the temperature in the non-paper-passage part low. To solve the problem of a temperature rise in the non-paper-passage part, the configuration in this embodiment efficiently radiates the heat of the heater 1 positively into the heater holder 2, reduces the thermal stress, and makes the heater 1 difficult to crack. Another advantage is that this configuration lowers the temperature difference between the center and the ends, thus ensuring the fixing of toner on small-size paper sheets and reducing the temperature rise in the non-paper-passage part.

Second Embodiment

Figure 10A:
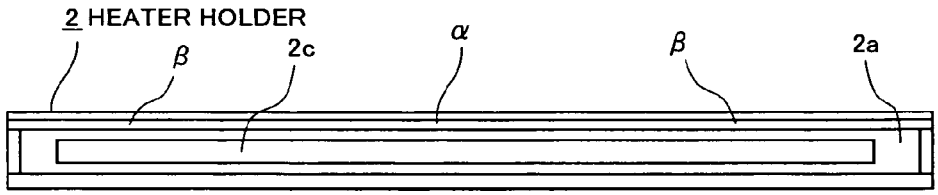
FIGS. 10A to 10C are diagrams, corresponding to FIGS. 1A to 1C, showing the configuration of a heater and a heater holder in a second embodiment of the present invention.
Figure 10B:
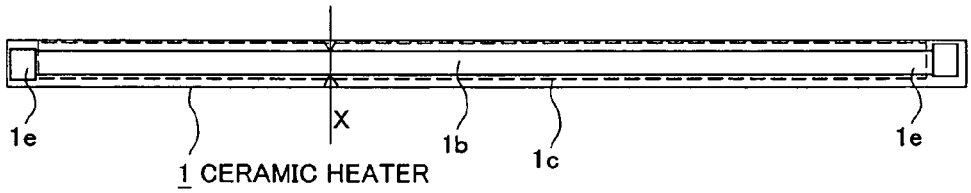
Figure 10C:
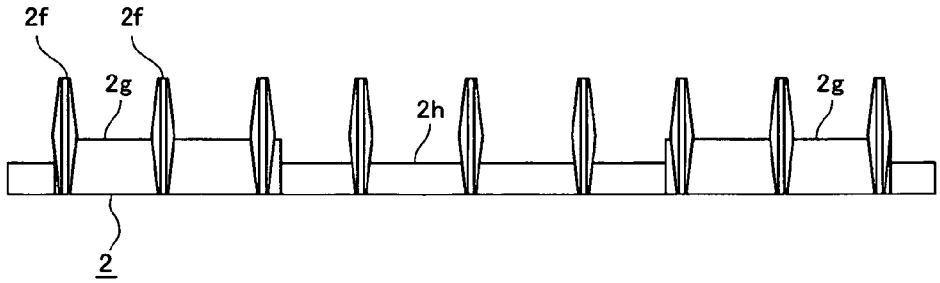

Next, a second embodiment of the present invention will be described. FIGS. 10A-10C are the diagrams, corresponding to those in FIG. 1, showing the second embodiment. A heater 1 is same as the heater 1 in the first embodiment described above and therefore its description is omitted. Although 1.0 mm thick in this embodiment, the heater substrate is not limited to this thickness.

Figure 11B:
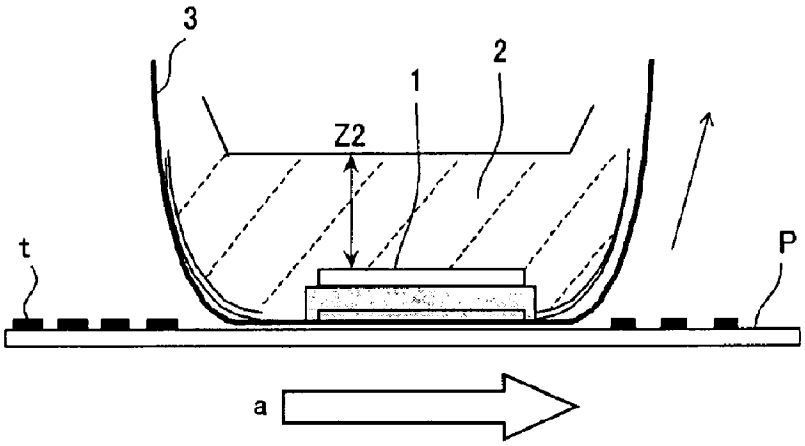
FIGS. 11A and 11B are cross sectional diagrams showing the heater abutting on the heater holder of the heat fixing device at the center and at the ends in the longitudinal direction in the second embodiment of the present invention.
Figure 11A:
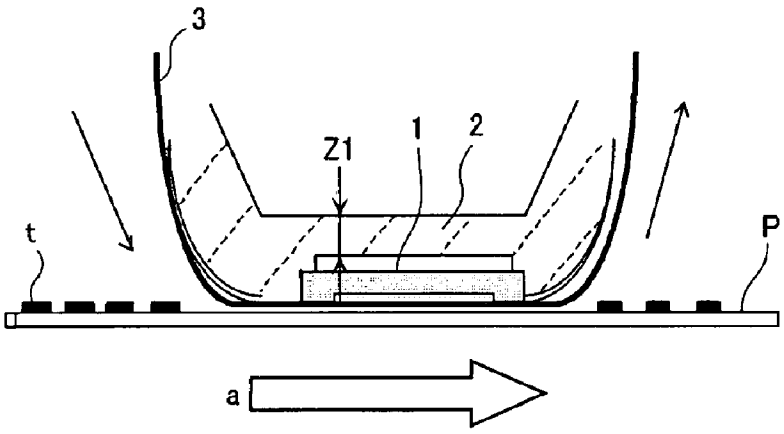

In the first embodiment, the contact rate between the heater holder 2 and the heater 1 is changed. In the second embodiment, the abutment surface between a heater holder 2 and the heater 1 is uniform in shape in both the longitudinal direction and the width direction of the heater 1 as shown in FIG. 10A. That is, the contact area between the heater holder 2 and the heater 1 is uniform in the longitudinal direction. However, as shown in FIG. 10B and FIGS. 11A and 11B that are cross sections perpendicular to the longitudinal direction of the heater holder 2, the cross sectional shape of the heater holder 2 differs between the end and the center of the heater 1. That is, the thickness of the part of the heater holder 2, which supports the heater 1, is Z1 (for example, 3.5 mm) at the ends where the temperature is high, and Z2 (for example, 6.0 mm) larger than Z1 at the center. Therefore, the per-unit-volume of the heater holder 2 in the longitudinal direction is large at the ends where the temperature of the heater 1 is high, but is small at the center. Therefore, because the volume of the heater holder 2 is made extremely small at the center, the rate of heat escape into the heater holder 2 can be reduced and thus the heat amount of the heater 1 can be transferred efficiently to the nip N side. On the other hand, because the volume of the heater guide 2 is large at the ends, the heat radiation effect can be enhanced and the heat amount of the heater 1 can be distributed between the nip N side and the heater holder 2 side. Thus, this configuration lowers the temperature in the nip N side near the ends.

When 50 sheets of narrow (A5 size) paper successively pass through the nip portion in the configuration described above, the temperature is distributed in such a way that the heat in the non-paper-passage part escapes easily into the heater holder 2, the thermal stress is reduced, and the heater 1 becomes difficult to crack. The configuration also lowers the temperature difference between the center and the ends, ensures the fixing of toner on small-size paper, and minimizes a temperature rise in the non-paper-passage part.

Third Embodiment

The general configuration of the temperature controller of a heater in a heat fixing device used in an image forming device in this embodiment is the same as that in the first and second embodiments shown in FIG. 9.

Figure 12A:
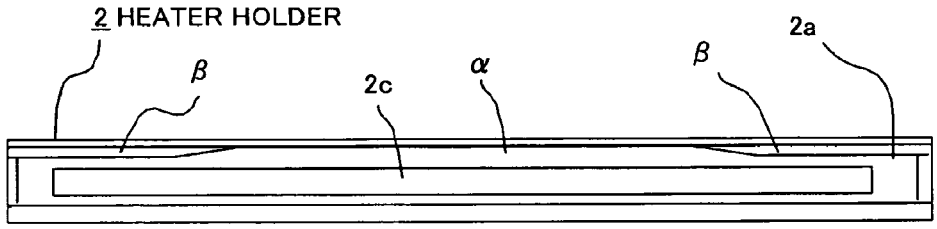
FIGS. 12A to 12C are diagrams, corresponding to FIGS. 1A to 1C, showing the configuration of a heater and a heater holder of a heat fixing device in a third embodiment of the present invention.
Figure 12B:
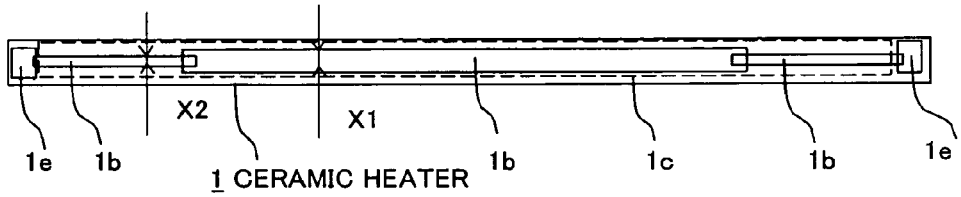
Figure 12C:
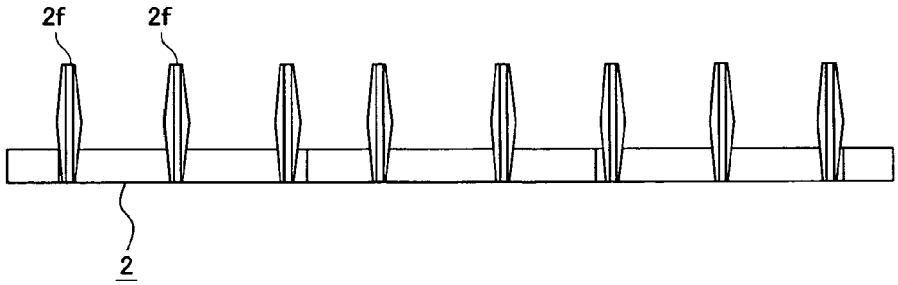

FIG. 12B is a top view of a heater 1 having a heating element, which is heated through conduction, in a third embodiment of the present invention. FIG. 12A is a top view of the heater fitting groove in a heater holder 2. FIG. 12C is a front view of the heater holder 2. The structure of the other components of the heat fixing device is the same as that of the corresponding components of the conventional technology shown in FIGS. 6A to 6C. Although 1.0 mm thick in this embodiment, the heater substrate is not limited to this thickness.

Figure 13:
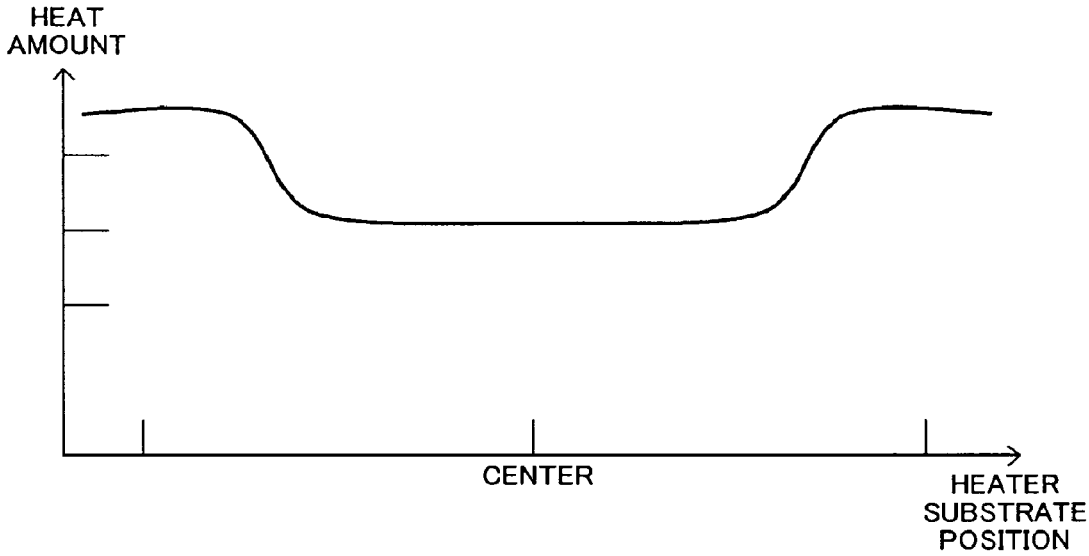
FIG. 13 is a diagram showing the heat amount distribution in the longitudinal direction of the heater of the heat fixing device in the third embodiment of the present invention.

The temperature distribution of the heater 1 is even in the longitudinal direction in the first and second embodiments, while the distribution is uneven in this embodiment. That is, the heat amount at both ends of the heater 1 is higher than that at the center as shown in FIG. 13. To allow the heat to be distributed in this way, the width of the electric resistant heater (heating element) 1*b* of the heater 1, 220 mm in total length, in this embodiment shown in FIG. 12B is made different between the center and the ends in the longitudinal direction. The width of the electric resistant heater 1*b* in the longitudinal direction is made different between the center and the ends. That is, the length X1 of the width of the electric resistant heater 1*b* within 91 mm (B5 size width) in both sides from the center in the longitudinal direction is set to 6.5 mm, with the resistance value per unit length in this range being Ro (100%). The length X2 of the width of the electric resistant heater 1*b* of the part, ranging from 91 mm to 110 mm in both sides from the center in the longitudinal direction, is set to 5.0 mm, with the per-unit-length resistance value in this range being 112% of Ro that is the per-unit-length resistance value at the center.

The heater holder 2 is made by molding heat stable resin such as PPS, liquid-crystal polymer, or phenol resin as in the embodiment described above. The heater holder 2 has a heater mounting surface in which the heater 1 is fitted. The shape of the mounting surface is such that the ends in the longitudinal direction of the heater project into the heater side as shown by β, with a gap α between the heater holder 2 and the heater 1 at the center. As shown in FIG. 12C, ribs 2*f* are formed in multiple positions in the longitudinal direction of the heater holder to guide a conveyed film 3.

Figure 14B:
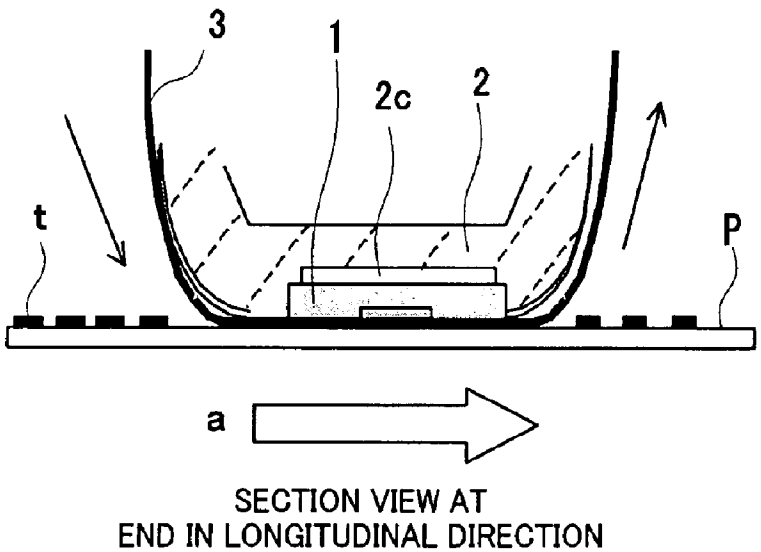
FIGS. 14A and 14B are cross sectional diagrams showing the center and the ends of the heat fixing device in the third embodiment of the present invention.
Figure 14A:
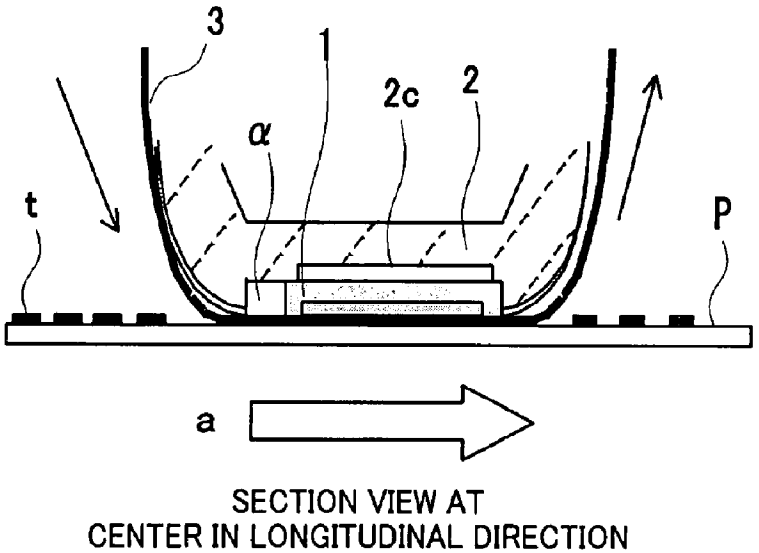

FIG. 14A and FIG. 14B are cross sectional diagrams of the center and the ends in the longitudinal direction of the heater 1 that abuts on, and supported by, the heater holder 2. There is the gap α between the heater holder 2 and the heater 1 at the center in the longitudinal direction in FIG. 14A, while the heater holder 2 abuts on, and makes close contact with, the sides of the heater 1 at the end in the longitudinal direction in FIG. 14B.

Figure 15:
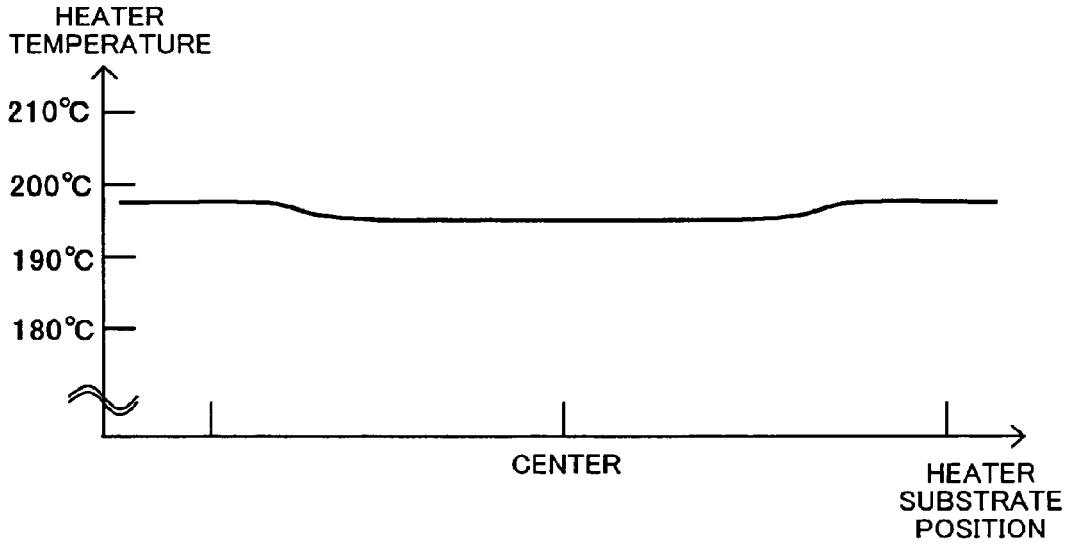
FIG. 15 is a diagram showing the temperature distribution in the longitudinal direction of the heater of the heat fixing device in the third embodiment of the present invention.

FIG. 15 shows the temperature distribution when the electric resistant heater 1*b* of the heater 1 conducts in the state described above. In this example, the temperature at the center is 195° C., and 198° C. at the ends, in the longitudinal direction. Because the contact rate between the heater 1 and the heater holder 2 (per-unit-area contact area of the heater 1) is set as low as possible, the heat insulation against the heater holder 2 is increased, the rate of the heat at the center that escapes into the heater holder 2 side is decreased and, as a result, the heat amount of the heater 1 is transferred efficiently to the nip N side. The configuration in this embodiment, where the heat amount of the heater 1 at the ends is larger than that at the center and the contact area between the heater 1 and the heater guide 2 is large, enhances the radiation effect. The configuration also distributes the heat amount of the heater 1 between the nip portion N side and the heater holder 2 side. Therefore, the temperature at the ends on the nip portion N side is decreased.

When the heat amount of the heater 1 varies at positions in the longitudinal direction as described above, the contact rate of the holder is set higher in a position where the heat amount of the heater 1 is large than in a position where the heat amount is small. This configuration prevents the temperature at the ends from falling below the temperature at the center or from going extremely high, thus making the temperature distribution in the longitudinal direction even.

Figure 16:
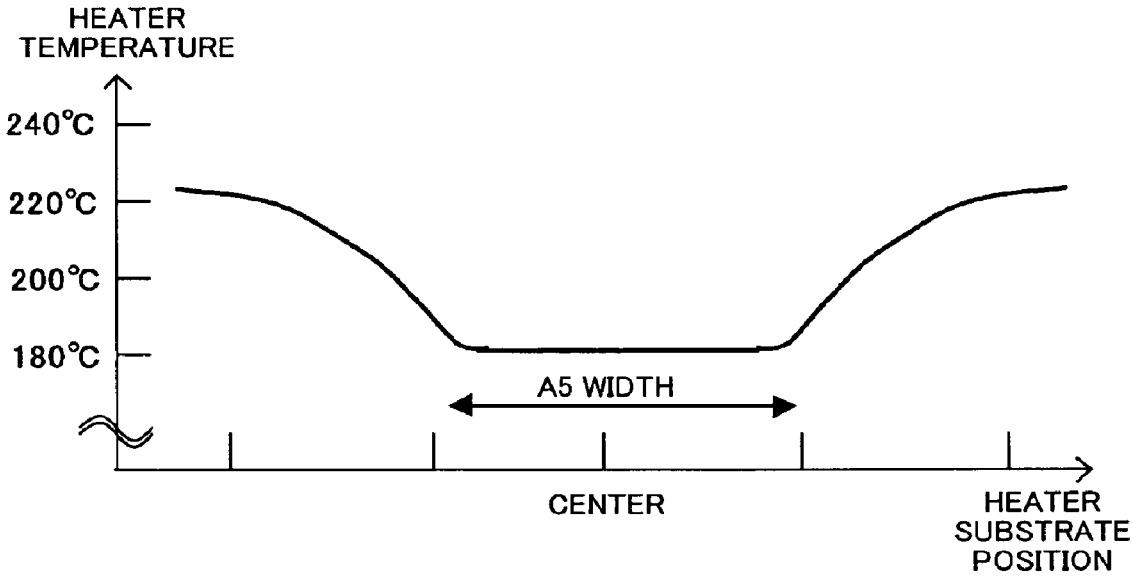
FIG. 16 is a diagram showing the temperature distribution in the longitudinal direction of the heater when small-size paper successively passes through the heat fixing device in the third embodiment of the present invention.

FIG. 16 shows the temperature distribution when 50 sheets of relatively narrow (A5 size) paper successively pass through the nip portion in the configuration in the third embodiment. In the configuration of this embodiment, the maximum temperature in the non-paper-passage part where no paper passes is 224° C. The comparison between this temperature with 242° C., which is the maximum temperature in the conventional configuration in FIG. 8, indicates that there is a temperature difference of about 20° C. or less. That is, even when 50 sheets of A5-size paper pass through the nip portion successively, the configuration in this embodiment can keep the temperature in the non-paper-passage part low. To solve the problem of a temperature rise in the non-paper-passage part, the configuration in this embodiment efficiently radiates the heat of the heater 1 positively into the heater holder 2, reduces the thermal stress, and makes the heater 1 difficult to crack.

The gap $\alpha$ in this embodiment is provided to make the contact rate between the heater and the holder at the center lower than that at the ends. The gap $\alpha$ may be provided not in the upstream side of the film conveyance as shown in the figure but in the downstream side. The gap $\alpha$ may also be provided even in both upstream and downstream sides.

Fourth Embodiment

The general configuration of the temperature controller of a heater in a heat fixing device used in an image forming device in this embodiment is the same as that in the other embodiments as shown in FIG. 9. The configuration of a heater 1 is the same as that of the heater in the third embodiment described above and therefore its description is omitted.

Figure 17A:
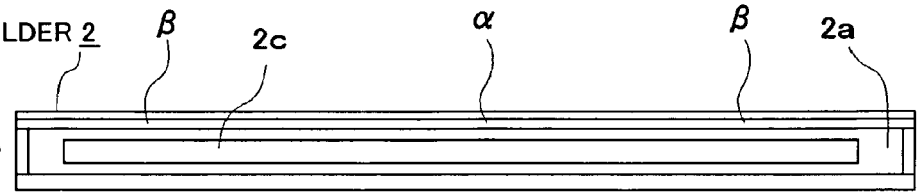
FIGS. 17A to 17C are diagrams, corresponding to FIGS. 1A to 1C, showing the configuration of a heater and a heater holder of a heat fixing device in a fourth embodiment of the present invention.
Figure 17B:
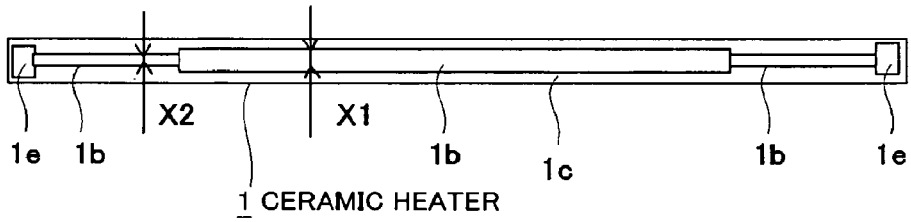
Figure 17C:
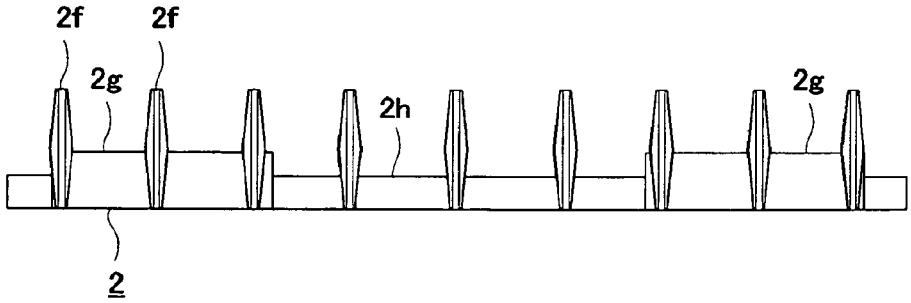
Figure 18B:
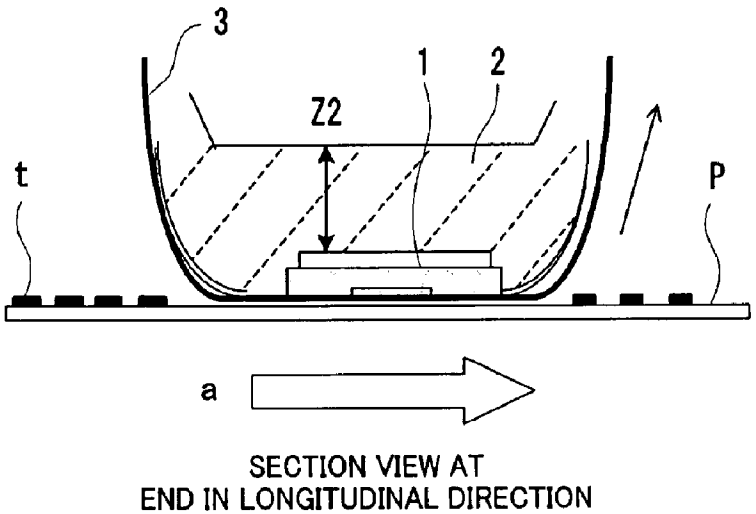
FIGS. 18A and 18B are diagrams showing the configuration of the heater and the heater holder of the heat fixing device in the fourth embodiment of the present invention.
Figure 18A:
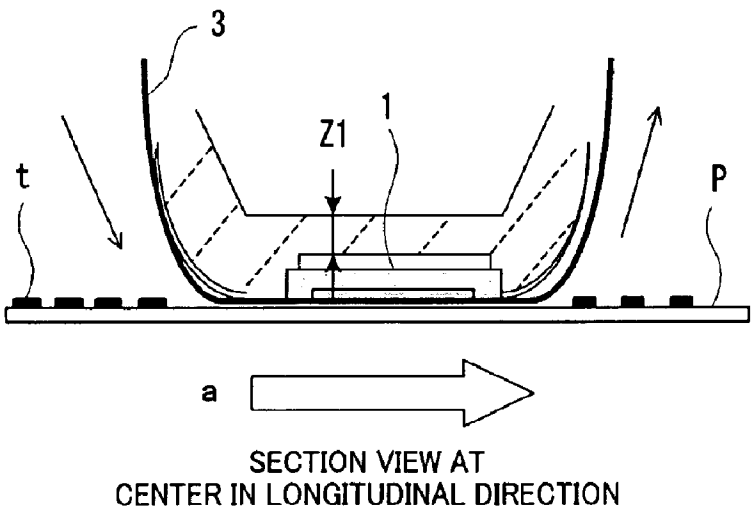

FIGS. 17A to 17C show the configuration of the heater 1 and a heater holder 2 in this embodiment. In the third embodiment, the contact area between the heater holder 2 and the heater 1 is changed. In contrast, the heater abutment surface of the heater holder 2 is constant across the whole length of the heater 1 in the longitudinal direction in the fourth embodiment as shown in FIG. 17A. The structure of the heater 1 shown in FIG. 17B is the same as that in the third embodiment. Although the contact area between the heater holder 2 and the heater 1 is even in the longitudinal direction in this embodiment as described above, the shape in the vertical direction at the end, where the heat amount of the heater 1 is large, is made different from the shape in the vertical direction at the center, where the heat amount of the heater 1 is small, as shown in FIG. 17C or in the cross sectional diagrams of the heater holder 2 in FIGS. 18A and 18B. That is, the thickness of the part of the heater holder 2 that supports the heater 1 is Z1 (3.5 mm in this embodiment) where the heat amount is small, and Z2 (6.0 mm in this embodiment), thicker than Z1, where the heat amount is large. The front view in FIG. 17C indicates that the protrusion height of backs 2*g* and the protrusion height of backs 2*h* differ between the end and the center of the heater holder 2.

Therefore, the per-unit-length volume (cross section area in FIGS. 18A and 18B) in the longitudinal direction of the heater holder 2 is small at the center where the heat amount of the heater 1 is small, but is large at the ends where the heat amount is large. As a result, because the volume of the heater holder 2 is extremely small at the center, the rate of the heat escaping into the heater holder 2 side can be reduced at the center to allow the heat amount of the heater 1 to be transferred efficiently to the nip portion N side. On the other hand, because the heat amount of the heater 1 at the ends is larger than that at the center and the volume of the heater guide 2 is large, the radiation effect can be increased at the ends during the actual use and the heat amount of the heater 1 is distributed into both the nip N side and the heater holder 2 side. Therefore, the temperature of the nip N side near the ends can be reduced.

When the heat amount of the heater 1 varies at positions in the longitudinal direction as described above, the volume of the holder in a position where the heat amount of the heater 1 is large is made larger than the volume in a position where the heat amount is small. This configuration prevents the temperature at the ends from falling below the temperature at the center or from going extremely high, thus making the temperature distribution in the longitudinal direction even.

Even when 50 sheets of narrow (A5-size) paper pass through the nip portion successively in the configuration described above, the temperature distribution in this embodiment ensures an efficient radiation effect of allowing the heat of the heater 1 to positively escape into the heater holder 2 in the non-paper-passage part, reduces the thermal stress, and makes the heater 1 difficult to crack.

The present invention provides a heat fixing device for heat fixing an unfixed image formed on a recording material wherein the heat amount transferred from the heater to the heater holder is locally reduced. Therefore, the heat fixing device according to the present invention can transfer the heat of the heater into the nip N side efficiently at the center and prevent a toner-peeling problem that would develop when an image cannot be fixed on narrow, thick paper because of an insufficient temperature.

In addition, by positively setting the distribution of the per-unit-length heat amount unevenly in the longitudinal direction of the heater, the present invention efficiently prevents improper fixing that conventionally occurs in a position where the temperature is insufficient.

At the same time, the device is configured in such a way that the heat generated by the heater can easily escape into the holder side in a position where the per-unit-length heat amount is large (for example, both ends) and the heat generated by the heater cannot easily escape into the holder side in a position where the per-unit-length heat amount is small (for example, center). This configuration can prevent an extreme increase in the temperature in the non-paper-passage part when a narrow recording material passes through the nip.

Although the preferred embodiments of the present invention have been described, it is to be understood that not only the embodiments but also various modifications and changes are possible. For example, the shapes, materials, and numeric values such as dimensions and temperatures used in the description are exemplary only and the present invention is not limited thereto. Although each of the first embodiment and the second embodiment can be implemented independently, both may also be combined. The same is true for the third embodiment and the fourth embodiment.

The invention claimed is:

1. A heat fixing device for heat fixing an unfixed image formed on a recording material, comprising:

a heater having a heating element; and a heater holder for supporting said heater;

wherein a distribution of a per-unit-length heat amount in a longitudinal direction of said heater is set uneven and a contact rate between said heater and said heater holder is set lower in a position where the per-unit-length heat amount is small than in a position where the per-unit-length heat amount is large.

2. The heat fixing device according to claim 1 wherein, on at least one surface of said heater, said heater contacts said heater holder in the position where the per-unit-length heat amount is large and a gap is formed between said heater and said holder in the position where the per-unit-length heat amount is small.

3. The heat fixing device according to claim 1, wherein the per-unit-length heat amount distribution of said heating element is set so that the per-unit-length heat amount at both ends in the longitudinal direction of said heater becomes larger than the per-unit-length heat amount at a center.

4. An image forming device comprising the heat fixing device according to claim 1.

5. The heat fixing device according to claim 1, wherein said heat fixing device employs a film heating method in which the recording material is heated by said heater via a film.

6. The heat fixing device according to claim 1 wherein small-size and large-size paper are selectively passed over said heater and an area where said small-size paper passes corresponds to the position where said contact rate is low.

7. A heat fixing device for heat fixing an unfixed image formed on a recording material, comprising:

a heater having a heating element, with a thin film sliding thereon; and a heater holder for supporting said heater such that said heater is fixed on a surface of said heater holder;

wherein a distribution of a per-unit-length heat amount in a longitudinal direction of said heater is set uneven such that the per-unit-length heat amount at both ends in the longitudinal direction of said heater becomes larger than the per-unit-length heat amount at a center and a contact rate between said heater and said heater holder is set lower in a position where the per-unit-length heat amount is small than in a position where the per-unit-length heat amount is large;

said contact rate being indicative of a ratio of an area of said heater holder that contacts the heater at the longitudinal side thereof, to an area of the surface of the heater at the longitudinal side thereof; and wherein small-size and large-size paper are selectively passed over said heater and an area where said small-size paper passes corresponds to the position where said contact rate is low.

* * * * *

UNITED STATES PATENT AND TRADEMARK OFFICE

CERTIFICATE OF CORRECTION

PATENT NO. : 7,778,584 B2
APPLICATION NO. : 12/135969
DATED : August 17, 2010
INVENTOR(S) : Ryuji Nishiyama and Shintaro Kawai It is certified that error appears in the above-identified patent and that said Letters Patent is hereby corrected as shown below:

Title Page, item (75) Inventors: The name of the second inventor should read as follows:

Shintaro KAWAI

Signed and Sealed this

Twelfth Day of October, 2010

David J. Kappos

David J. Kappos
*Director of the United States Patent and Trademark Office*